US006923508B2

(12) United States Patent
Holl et al.

(10) Patent No.: US 6,923,508 B2
(45) Date of Patent: Aug. 2, 2005

(54) STRIPPING MEANS FOR MILLING ROLLS OF A CONSTRUCTION MACHINE AS WELL AS A CONSTRUCTION MACHINE AND A METHOD

(75) Inventors: Bernd Holl, Neustadt (DE); Herbert Ley, Katharinen (DE); Guenther Haehn, Koenigswinter (DE)

(73) Assignee: Wirtgen GmbH, Windhagen (DE)

( * ) Notice: Subject to any disclaimer, the term of this patent is extended or adjusted under 35 U.S.C. 154(b) by 0 days.

(21) Appl. No.: 10/681,201

(22) Filed: Oct. 9, 2003

(65) Prior Publication Data

US 2004/0075330 A1 Apr. 22, 2004

(30) Foreign Application Priority Data

Oct. 11, 2002 (DE) ..... 102 47 579

(51) Int. Cl.[7] ..... E01C 23/88
(52) U.S. Cl. ..... 299/39.4; 299/36.1; 404/90
(58) Field of Search ..... 299/56.1, 39.1, 299/39.2, 39.7, 39.5; 404/90

(56) References Cited

U.S. PATENT DOCUMENTS 5,441,361 A * 8/1995 Campbell ..... 404/90
6,296,318 B1 * 10/2001 Simons et al. ..... 299/39.2

FOREIGN PATENT DOCUMENTS

DE 38 23 480 C1 7/1988

* cited by examiner

*Primary Examiner*—John Kreck
(74) *Attorney, Agent, or Firm*—Diller, Ramik & Wight

(57) ABSTRACT

In a stripping means for milling rolls (2) of a construction machine, comprising at least one stripping blade (8) arranged behind the milling roll (2) in traveling direction so as to be adjustable in height, which is able to glide over the surface (3) milled or to be milled by the at least one milling roll (2), it is provided that the stripping blade (10) covers the maximum milling width, and that a mounting means (16) adjustable in height relative to the stripping blade (20) is arranged for at least one lower stripper portion (20) adapted to the respectively used milling roll (2) or milling rolls, the lower stripper portion (20) being able to be positioned, by means of the mounting means (16), in a position corresponding to the milling roll (2) within the width of the stripping blade (10).

24 Claims, 9 Drawing Sheets

STRIPPING MEANS FOR MILLING ROLLS OF A CONSTRUCTION MACHINE AS WELL AS A CONSTRUCTION MACHINE AND A METHOD

BACKGROUND OF THE INVENTION

1. Field of the Invention

The invention relates to a stripping means for milling rolls on a construction machine, an automotive construction machine, particularly a road milling machine and the method thereof.

2. Description of Related Art

Road milling machines are known wherein milling rolls of different milling widths are applicable within a maximum milling width. A transporting means for transporting the milled-off material is located in front of or behind the milling roll in the traveling direction thereof. Behind the millling roll in the traveling direction thereof, a stripping blade is arranged in a height-adjustable manner, said stripping blade being able to glide over the surface milled by the milling roll and clean this surface from the remaining milled-off material.

Particularly with road milling machines permitting a quick exchange of milling rolls of different milling width, it is desirable that the stripping blade is quickly adaptable to the milling width respectively required.

The stripping blade is required for scraping milled-off material accumulating behind the milling roll in the traveling direction thereof off the milled surface and leaving a milled surface as clean as possible. The accumulated material behind the milling roll is supplied to the milling roll again until it is picked up and carried away by the transporting means.

From German Patent DE 38 23 480 C, a segmented stripping blade is known wherein the individual segments are arranged so as to be separately adjustable in height to adapt to different milling widths of various milling rolls. The segments are arranged next to each other in a row. There is the disadvantage that due to the fixed width of the segments, only milling rolls with a width corresponding to the segmentation of the stripping blade segments are applicable. Furthermore, the position of the milling roll is fixed by the segmentation.

SUMMARY OF THE INVENTION

Therefore, it is the object of the invention to provide a stripping means for milling rolls of a construction machine, an automotive construction machine, particularly a road milling machine, as well as a method, by means of which an adaptation to the milling roll width is possible in a flexible manner, at low costs and at low mounting efforts.

The invention advantageously provides that a stripping blade covers the maximum milling width and that a mounting means adjustable in height relative to the stripping blade is provided for at least one lower stripper portion adapted to the respectively used milling roll or milling rolls.

By means of the mounting means, the lower stripper portion is adapted to be positioned in a position within the width of the stripping blade corresponding to the respective milling roll.

When the milling roll is exchanged, the lower stripper portion is positioned or mounted at the mounting means. In case of two milling rolls spaced from each other, either two lower stripper portions or one uniform lower stripper portion adapted to the milling contour produced by the two milling rolls are positioned at the mounting means. Such a lower stripper portion, for example, is adapted to be used for milling at both sides of rails.

The invention advantageously permits that the stripping blade is able to glide on the surface to be milled while the lower stripper portion glides on the milled surface. Due to the fact that the mounting means is adjustable in height independently of the stripping blade, the stripping means can also be used in those cases where work is done at varying milling depths. In this case, the stripping blade lies on the surface to be milled or has a specified distance thereto, while the lower stripper portion is adaptable to the respective milling depth in correspondence to the varying milling depth by means of the mounting means.

Therefore, the stripping means according to the invention can also be used such that the stripping blade is spaced from the surface to be milled whereas the lower stripper portion lies on the milled surface. In this case, a portion of the milled-off material is deposited next to the milled surface.

It is particularly advantageous that the stripping means can be adapted to the respectively used milling roll of different milling widths, different milling roll contours and different milling roll positions at low mounting efforts, whereby only the lower stripper portion has to be exchanged.

Preferably, the mounting means is arranged behind the stripping blade in the traveling direction thereof.

The profile shape of the lower stripper portion is adapted to the milling roll profile shape. Thus, the lower stripper portion can also be used for milling rolls having no circular cylindrical shape, e.g., with a milling groove being V-shaped in cross section.

Preferably, the mounting means extends over the entire maximum milling width and is arranged in parallel with and/or behind the stripping blade in the traveling direction thereof. Due to the fact that the mounting means extends over the entire width of the stripping blade, a positioning or mounting of the lower stripper portion is possible at any site within the width of the stripping blade.

In a preferred embodiment, it is provided that the mounting means carries a lower stripper portion extending over the entire milling width as well. When a milling roll with maximum milling width is used, it is therefore possible to use the stripping means with the stripping blade and the lower stripper portion as a second stripping blade and set both stripping blades upon the milled surface. In doing so, the first stripping blade can be operated at a lower contact pressure. Due to the fact that the milled surface is stripped double, a higher degree of cleanliness can be achieved.

The lower and/or lateral edges of the lower stripper portion as well as the lower edges of the stripping blade comprise wear strips. The wear strips are exchangeable and preferably consist of wear-resistant hard metals.

The lower stripper portion that is adjustable in height relative to the stripping blade is displaceable along a guide parallel to and/or on the stripping blade. The lower stripper portion, for example, may be displaceable along a substantially vertical rail guide on the stripping blade or, independently of the stripping blade, in a lateral guide in parallel with the stripping blade. The stripping blade and the lower stripper portion may be slightly inclined against the traveling direction.

The lower stripper portion may comprise at least one opening for the defined deposition of the milled-off material.

The opening consists of a recess downwardly open by means of which specifically milled-off material can be deposited in the form of strips on and/or next to the milled surface. If milled-off material is to be deposited next to the milled surface, the lower stripper portion may comprise a laterally projecting section arranged at a distance from the surface to be milled in order to deposit the milled-off material. Generally, the contour of the lower stripper portion can be chosen freely so that a quick adaptation to different objectives can be effected because of the quick exchangeability of the lower stripper portion.

The first stripping blade may comprise wear strips with rounded lower edges and/or the lower stripper portion may comprise wear edges with substantially sharp lower edges.

In one embodiment, it may be provided that the stripping means receives a transporting means, preferably in an articulated manner, behind the milling roll in traveling direction.

To this end, it may be provided that the transporting means is articulately mounted to the mounting means in traveling direction behind the roll. Thus, it is evident that the invention is also applicable to a road milling machine of the rear loader type.

The stripping blade and/or the mounting means comprise a passage opening for the ejection of the milled-off material onto the transporting means.

The transporting means may be articulately connected to the mounting means so as to be pivoted about a horizontal as well as about a substantially vertical axis.

Relative to the transporting means, the lower edge of the passage openings is independent of the set milling depth.

According to a method according to the invention, it is provided that a lower stripper portion is used for stripping the milled surface at a constant or varying milling depth, which is positioned corresponding to the position of the respectively used milling roll by means of a mounting means that is adjustable in height relative to the stripping blade.

BRIEF DESCRIPTION OF THE DRAWINGS

Hereinafter, embodiments of the invention are explained in detail with reference to the drawings.

DETAILED DESCRIPTION OF THE PREFERRED EMBODIMENT OF THE INVENTION

Figure 1:
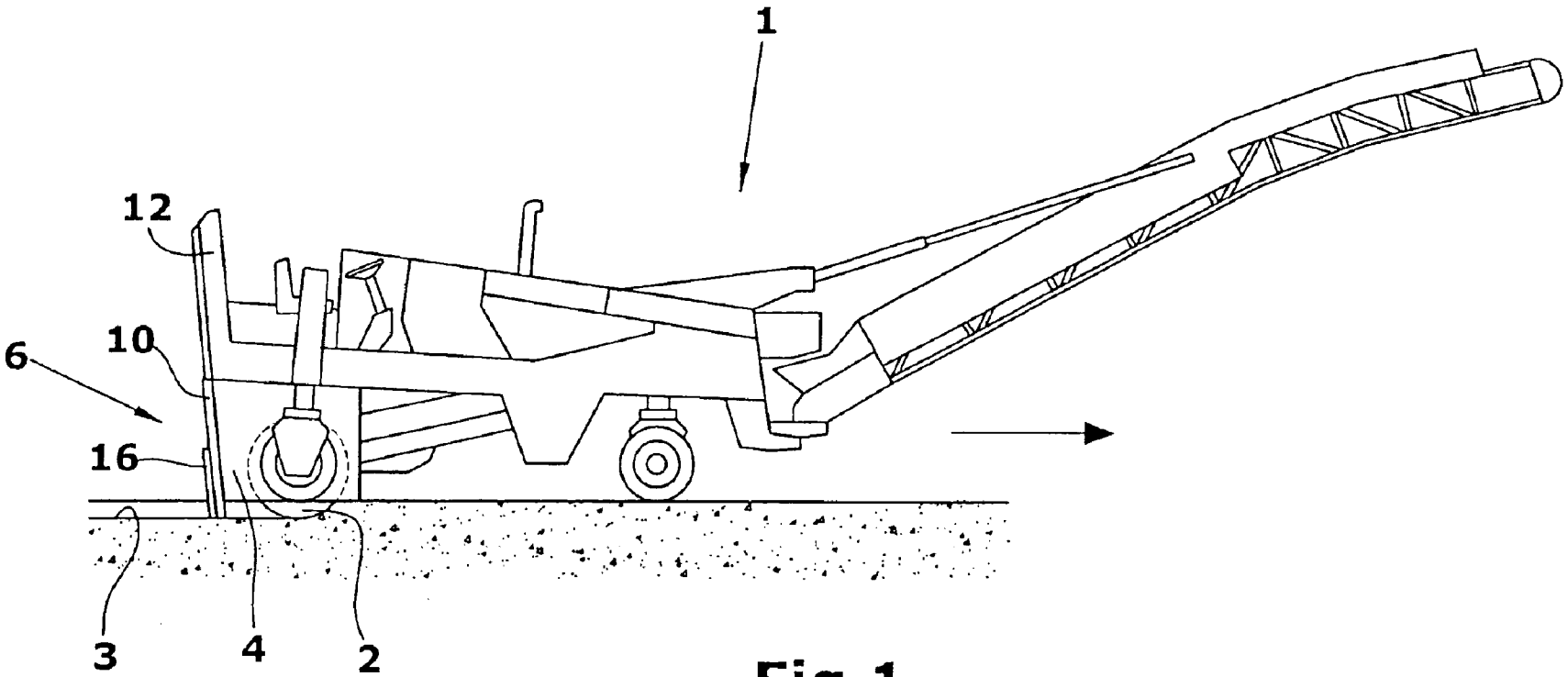
FIG. 1 shows a front loader road milling machine according to the invention.

FIG. 1 shows the application of the invention with a front loader road milling machine.

Such road milling machines 1 may be provided with a quick change system for the milling rolls by means of which a change of the milling roll 2 is possible within a short time and at low mounting efforts. Thereby, different orders can be worked with the same road milling machine.

Figure 2:
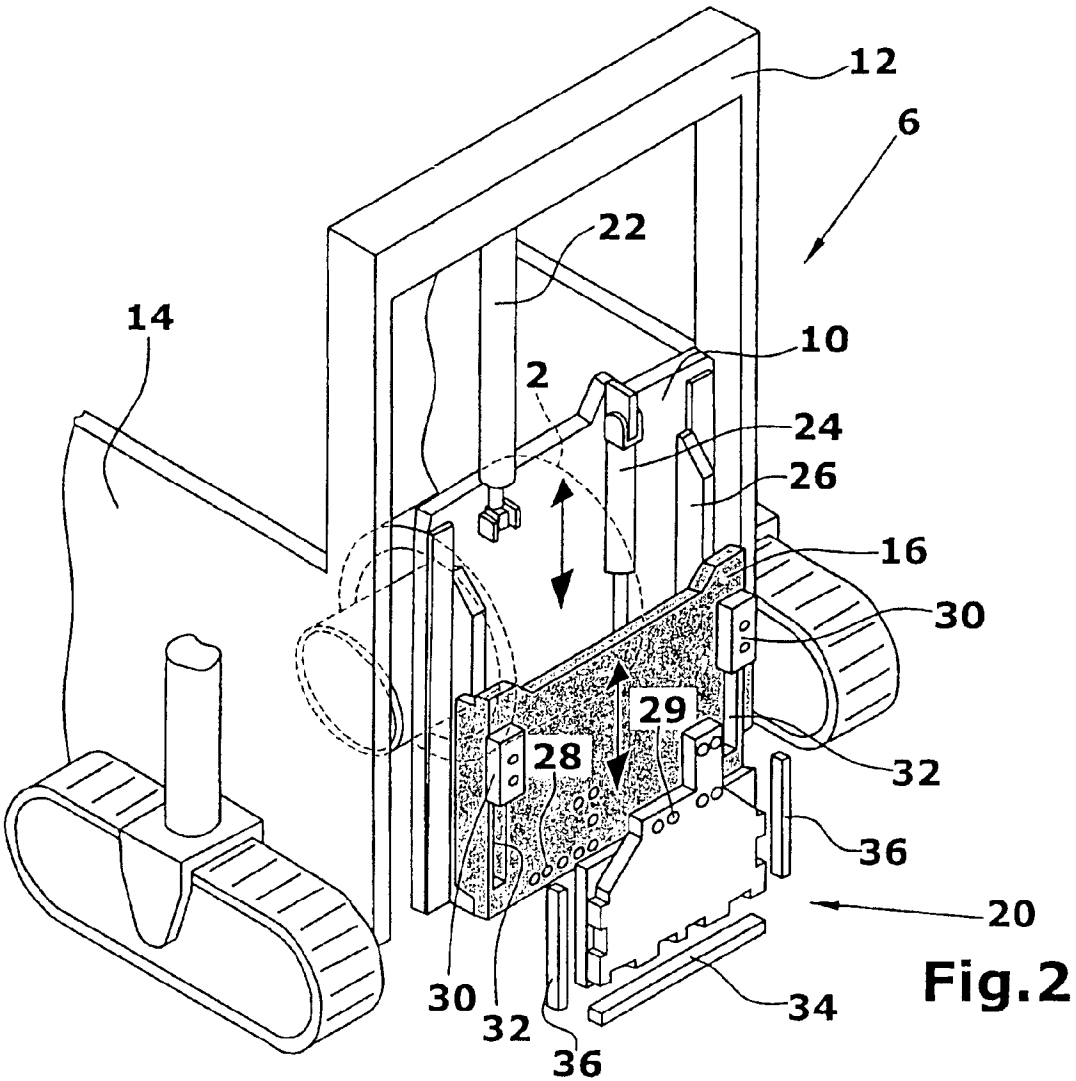
FIG. 2 shows the stripping means according to the invention behind a milling roll.
Figure 3:
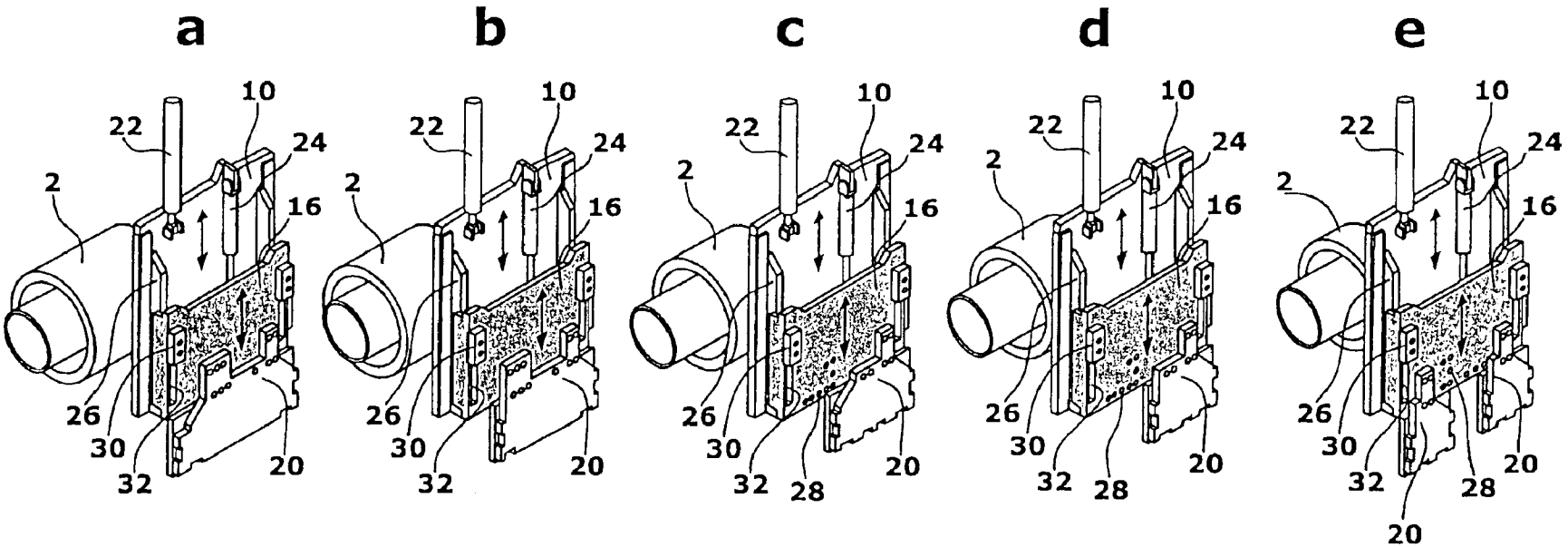
FIGS. 3*a* to 3*e* show the stripping means according to the invention with different lower stripper portions adapted to the milling roll width.

In FIG. 1, the automotive road milling machine 1 is equipped with wheels, but it may of course be also supported by chain running gears as shown in FIG. 2.

In the embodiment of the road milling machine 1 according to FIG. 1, the milling roll 2 is arranged at the rear end of the machine and surrounded by a roll box 4. At the rear end of the roll box 4 in traveling direction, a stripping means 6 that is adjustable in height is arranged, comprising a stripping blade 10 covering the maximum milling width of the widest milling roll 2 and being guided in a height-adjustable manner, for example, in a portal 12 of the machine frame 14. As can be seen best in FIG. 2, a shield-shaped mounting means 16 for a lower stripper portion 20 is guided in a height-adjustable manner in parallel with the stripping blade 10 at the first stripping blade 10 or at the portal 12 of the machine frame 14.

Because of the better accessibility in traveling direction, the mounting means 16 is preferably arranged behind the stripping blade 10 and furthermore, it is arranged such that it is adapted to be moved up and down parallel to the stripping blade 10 by means of a piston-cylinder unit 24.

The first stripping blade 10, in turn, is adapted to be moved up and down relative to the machine frame 14 and relative to the portal 12, respectively, or relative to a roll box of the milling roll 2 via a piston-cylinder unit 22.

In this case, it is preferably provided that the stripping blade 10 is guided in lateral longitudinal guides of the portal 12.

The mounting means 16 may also be guided in a longitudinal guide of the portal 12 or, as shown in the embodiments of FIGS. 2 to 5, be displaceable along a rail guide 26 on the stripping blade 10 by means of the piston-cylinder unit 24.

As can be seen from FIG. 2, the mounting means 16 preferably extends over almost the entire width of the stripping blade 10.

Holding means 30 of the rail guide 26 consist of mounting screws led through a groove stone and a groove 32 and adapted to be screwed down in the stripping blade 10.

With respect to width and contour, the lower stripper portion 20 is adapted to the outer contour of the milling roll 2. In case of a circular cylindrical milling roll 2 as shown in the figures, the lower edge of the lower stripper portion 20 is linear and parallel to the axis of the milling roll 2. Correspondingly, the lower edge extends arcuately in a barrel-shaped milling roll 2, for example.

The mounting means 16 comprises a plurality of bores 28 permitting to mount the lower stripper portion, by means of mounting screws and passage holes 29 of the lower stripper portion 20, at different positions, preferably in right alignment or also in left alignment, but in intermediate positions as well.

As can be seen from FIGS. 3*a* to 3*e*, different lower stripper portions 20 can be mounted to the mounting means 16, said lower stripper portions being adapted to be mounted at the mounting means 16 easily and in a short time when a milling roll is changed.

Figure 5:
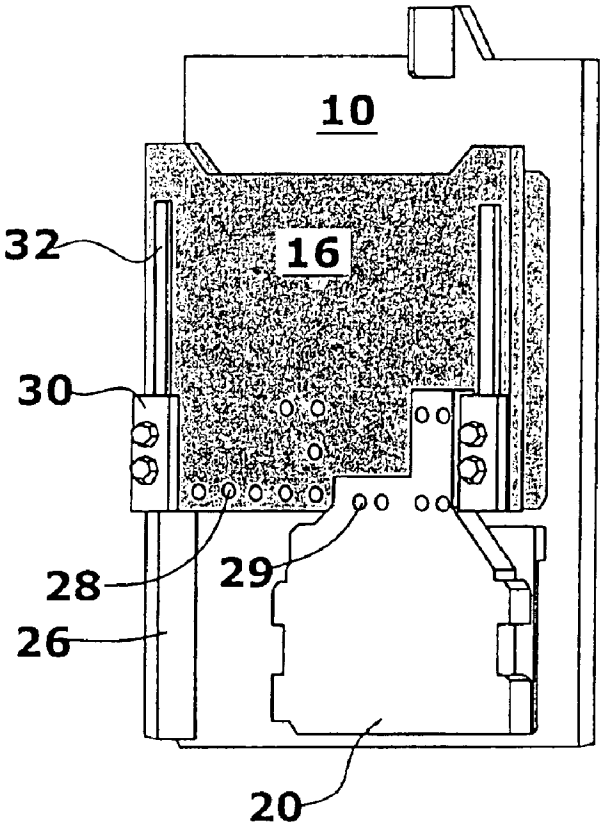
FIG. 5 shows a possible arrangement of the lower stripper portion upon milling with the maximum milling width.
Figure 4:
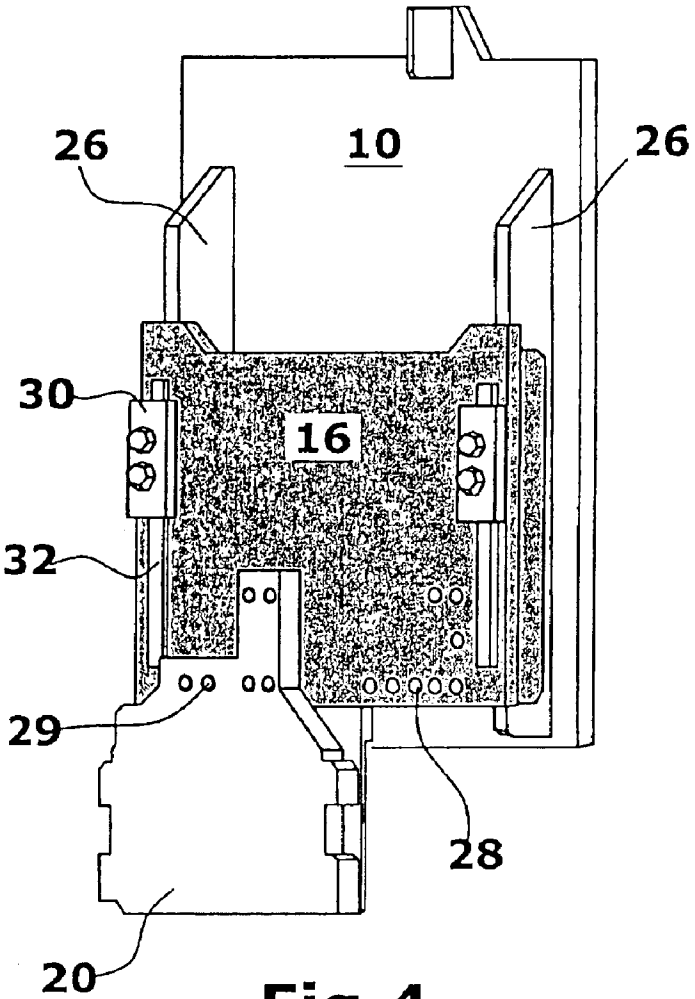
FIG. 4 shows a position of the lower stripper portion in case of an arrangement of the milling roll in left alignment.

As can be seen from FIGS. 4 and 5, a different arrangement of a lower stripper portion 20 of the same width is possible at the shield-shaped mounting means 16.

At the lower edge of the lower stripper portion 20, a recess open towards the milled surface 3 may be provided in order to deliberately deposit a strip of milled-off material on the milled surface 3 for further use.

Furthermore, as shown in FIG. 5, the stripping means can also be used in a position where only the stripping blade 10 is in contact with the milled surface when a milling roll with maximum milling width is used.

The stripping means also permits an operational mode wherein the stripping blade 10 does not lie on the surface to be milled but is held at a distance thereto, while the mounting means 16 with the lower stripper portion 20 is moved down such that the lower edge of the lower stripper portion 20 glides upon the milled surface 3. In this case, material can be deposited laterally next to the milling area, the amount of the deposited material being adjustable by the distance of the lower edge of the stripping blade 10 to the non-milled surface.

When the full milling width is used, the stripping means can finally also be operated with a lower stripper portion 20 with the maximum milling width, the milled surface 3 being then able to be stripped by both the stripping blade 10 and the lower stripper portion of the same width in order to achieve a higher degree of cleaning (FIG. 3*a*).

Figure 11:
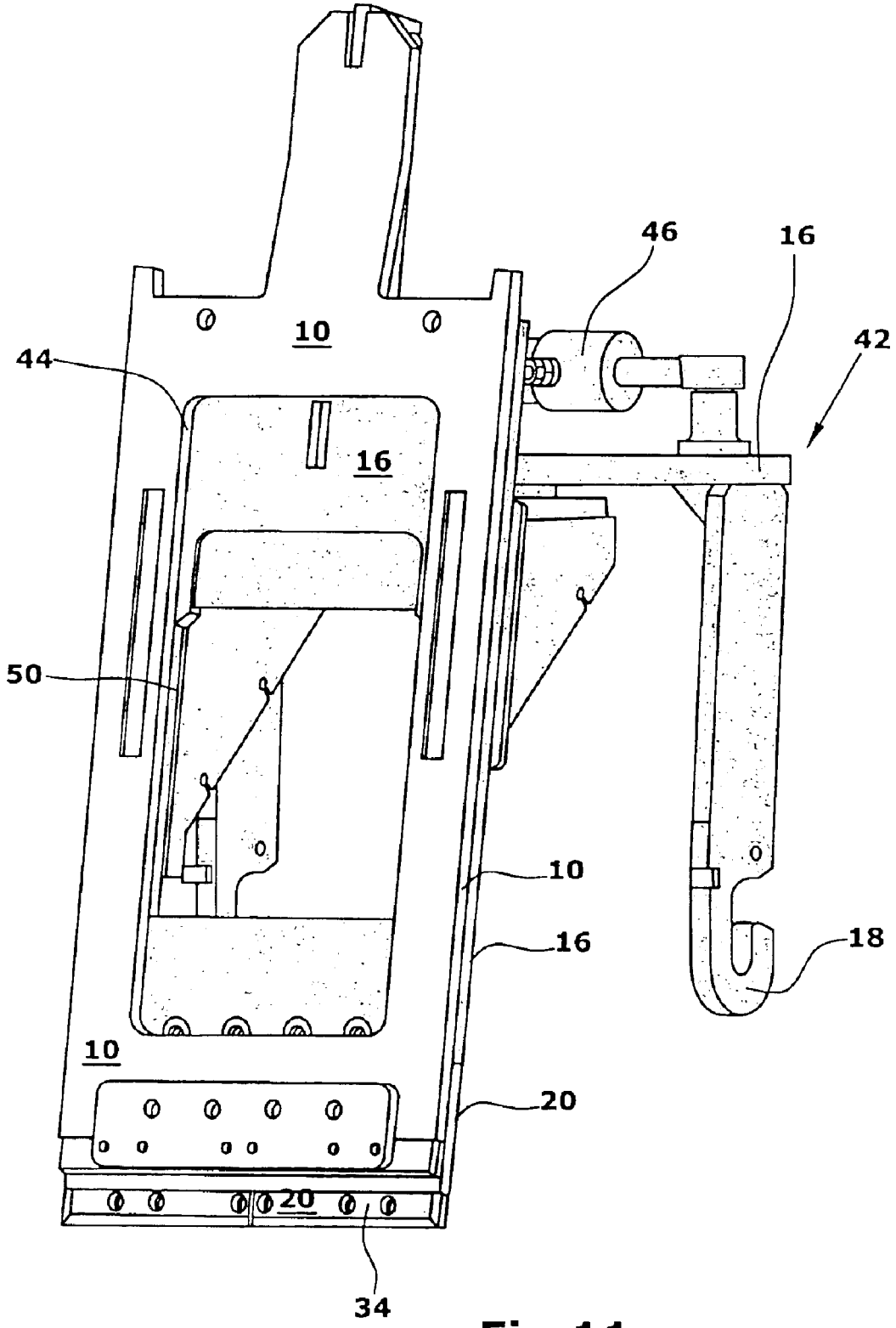
FIG. 11 shows a plan view of the stripping blade of the stripping means in an embodiment of the stripping means for a rear loader road milling machine.

As can be seen from FIGS. 2 and 11, the lower edge as well as the lateral edges of the lower stripper portion 20 comprise wear strips 34,36 that are exchangeable.

The lower edges and lateral edges of the stripping blade 10 are also provided with wear strips (not illustrated in the drawings).

If the stripping blade 10 and a lower stripper portion 20 of almost the same width are used, different wear strips can be used at the lower edges of the stripping blade 10 and at the lower edges of the lower stripper portion 20. In case of double passing over the milled surface 3, the wear strip of the stripping blade 10 may have rounded edges, whereas the lower wear strip 34 of the lower stripper portion 20 may be provided with sharp edges. In this case, a coarse cleaning can be effected with the stripping blade 10 at a decreased pressure against the milled surface 3, while the lower stripper portion 20 can operate at an increased pressure against it.

Figure 6:
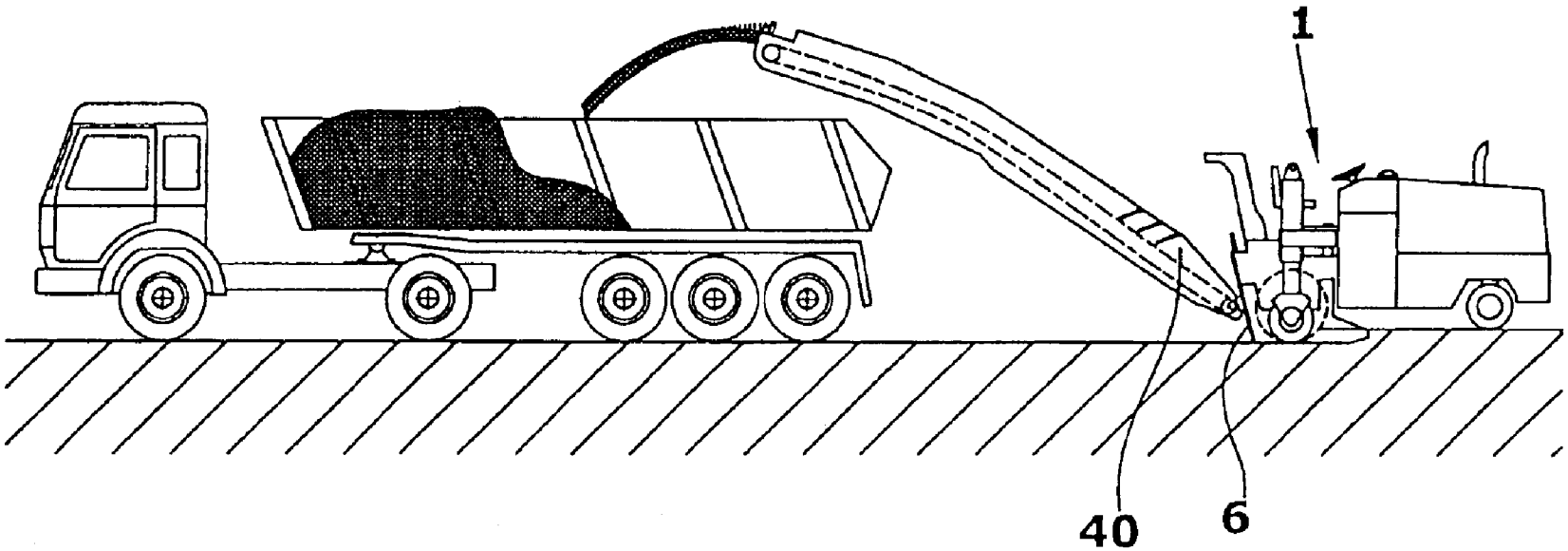
FIG. 6 shows a rear loader road milling machine according to the invention.

In the same way as illustrated in principle in FIG. 6, the described stripping means 6 is also applicable to a rear loader road milling machine.

Figure 7:
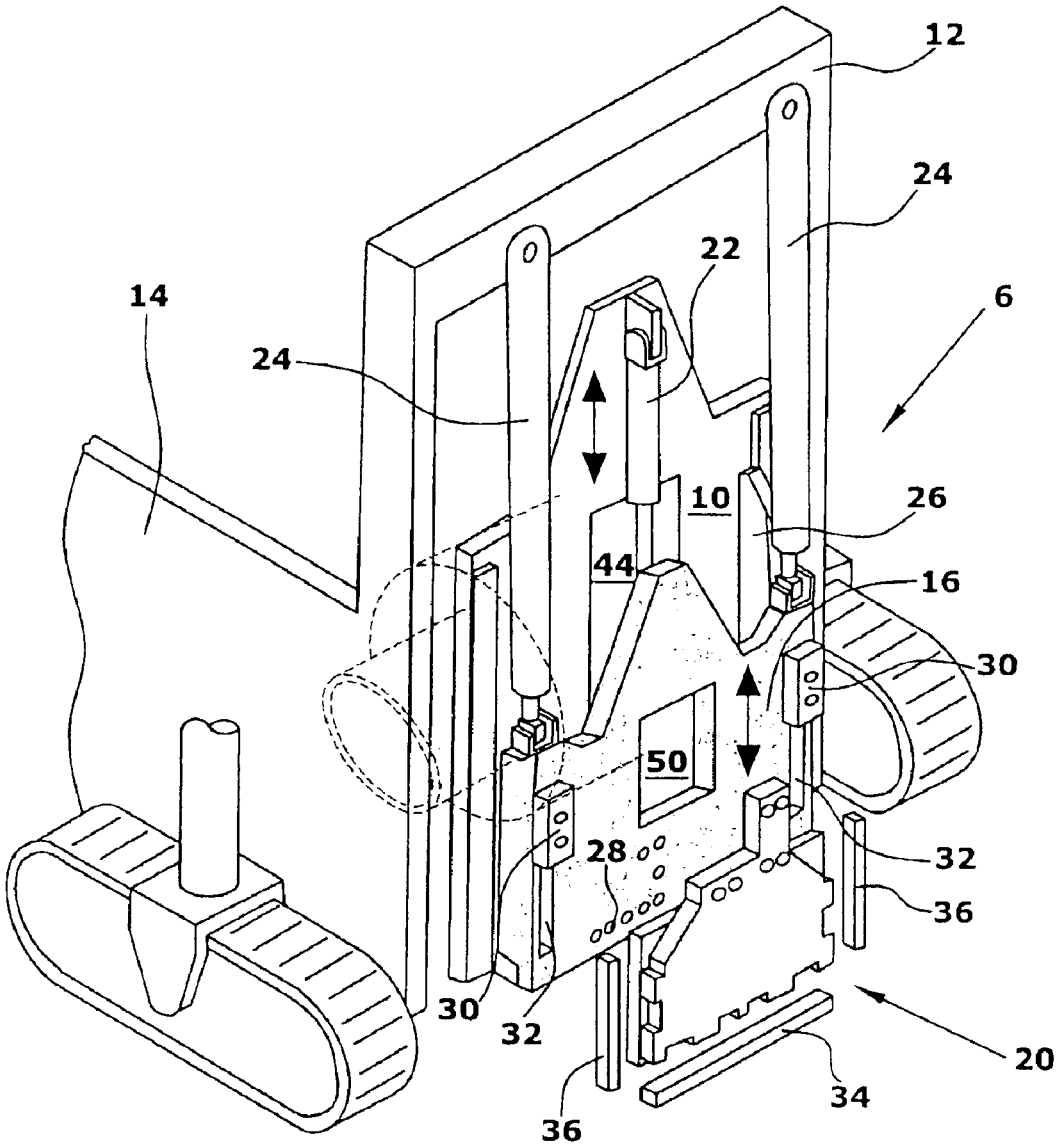
FIG. 7 shows a schematic representation of the stripping means in a rear loader road milling machine, corresponding to FIG. 2.
Figure 9:
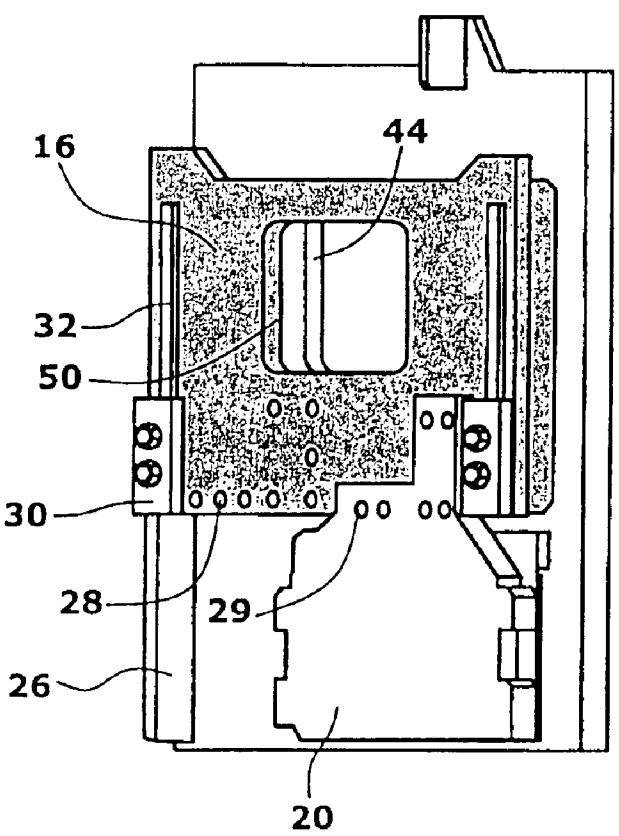
FIG. 8 and FIG. 9 show representations of the stripping means in a rear loader road milling machine, corresponding to FIGS. 4 and 5.
Figure 8:
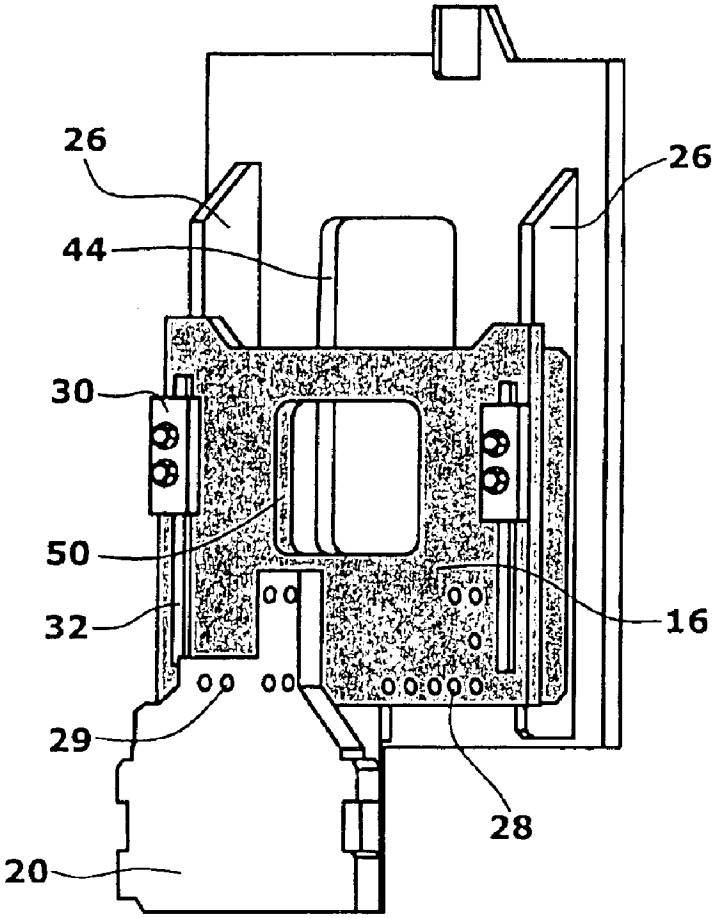

To this end, it is only required to provide the stripping blade 10 and/or the mounting means 16 with corresponding recesses or passage openings 44,50 as illustrated, for example, in FIGS. 7 to 9.

Such a stripping means 6 may comprise a supporting means 42 for a transporting means 40 which, for example, is provided with hooks 18 at both sides to be able to receive a bearing pin at both sides of the transporting means 40. Accordingly, as can be seen from FIG. 10, the transporting means 40 is articulately connected to the stripping means at its end facing the road milling machine so as to be pivoted about a horizontal axis. Via a pivoting means 46, the supporting means 42 is furthermore adapted to be pivoted about a substantially vertical axis to be able to pivot the transporting means 40 laterally.

Figure 10:
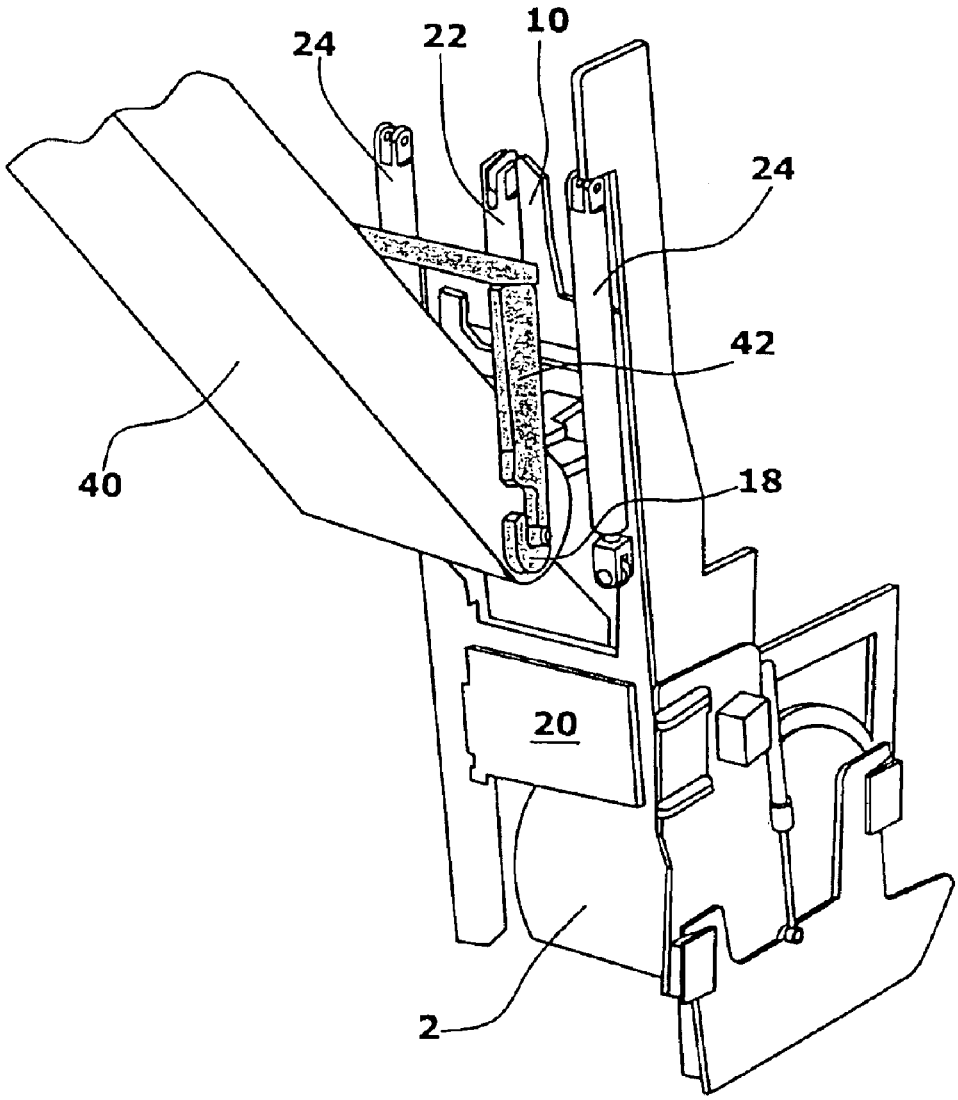
FIG. 10 shows the suspension of a transporting means at the stripping means according to the invention.

Via two piston-cylinder units 24 which are articulately connected to the portal 12 or to the machine frame, the mounting means 16 may be lifted or lowered, while the stripping blade 10 can be moved up and down relative to the mounting means 16 by means of the piston-cylinder unit 22 to be seen in FIG. 10.

Although the invention has been described and illustrated with reference to specific illustrative embodiments thereof, it is not intended that the invention be limited to those illustrative embodiments. Those skilled in the art will recognize that variations and modifications can be made without departing from the true scope of the invention as defined by the claims that follow. It is therefore intended to include within the invention all such variations and modifications as fall within the scope of the appended claims and equivalents thereof.

What is claimed is:

1. A road milling machine comprising means for establishing a predetermined maximum milling width for a milling roll of maximum milling width, a first stripping blade having a width corresponding to the maximum milling width, means for supporting the first stripping blade for vertical sliding movement behind a milling roll in the direction of machine travel, means for vertically adjusting the position of the first stripping blade whereby milled-off material can be removed from substantially the entire maximum milling width of a milled surface, at least one second stripping blade of a width substantially less than the width of the first stripping blade for use in conjunction with another milling roll having a width corresponding substantially to said second stripping blade width, means for supporting said second stripping blade for vertical sliding movement relative to said first stripping blade, and means for vertically adjusting the position of the second stripping blade relative to the first stripping blade whereby milled-off material can be removed from a narrow surface of a milled surface corresponding to the second stripping blade width.

2. The road milling machine as defined in claim 1 including at least a third stripping blade carried by said second stripping blade supporting means.

3. The road milling machine as defined in claim 1 including at least a third stripping blade carried by said second stripping blade supporting means, and said vertical position adjusting means is constructed and arranged for vertically adjusting the position of said third stripping blade.

4. The road milling machine as defined in claim 1 including at least a third stripping blade carried by said second stripping blade supporting means, and said vertical position adjusting means is constructed and arranged for vertically adjusting the position of said third stripping blade substantially simultaneously with the vertical adjustment of said second stripping blade.

5. The road milling machine as defined in claim 1 wherein said supporting means is located between the first and the at least one second stripping blades.

6. The road milling machine as defined in claim 1 wherein said supporting means is located behind the first stripping blade in the milling machine direction of travel.

7. The road milling machine as defined in claim 1 wherein at least a lower stripper edge portion of one of said first and at least one second striping blades is contoured to the profile of an associated milling roll.

8. The road milling machine as defined in claim 1 wherein the supporting means has a width corresponding substantially to the width of said first stripping blade.

9. The road milling machine as defined in claim 1 wherein said at least one second stripping blade includes a wear strip along a lower edge thereof.

10. The road milling machine as defined in claim 1 wherein said at least one second stripping blade includes wear strips along lower and lateral edges thereof.

11. The road milling machine as defined in claim 1 wherein said supporting means is vertically slidingly mounted relative to said first stripping blade.

12. The road milling machine as defined in claim 1 wherein said supporting means is a plate having lateral edges vertically slidingly mounted relative to said first stripping blade.

13. The road milling machine as defined in claim 1 wherein said at least one second stripping blade includes a lower edge having a downwardly opening recess.

14. The road milling machine as defined in claim 1 wherein said first stripping means includes opening means for the ejection of milled-off material therethrough.

15. The road milling machine as defined in claim 1 wherein said supporting means includes opening means for the ejection of milled-off material therethrough.

16. The road milling machine as defined in claim 1 wherein said first stripping means includes opening means for the ejection of milled-off material therethrough, and said supporting means includes opening means for the ejection of milled-off material therethrough.

17. The road milling machine as defined in claim 2 wherein said supporting means is located behind the first stripping blade in the milling machine direction of travel.

18. The road milling machine as defined in claim 2 wherein at least a lower stripper edge portion of one of said first and at least one second striping blades is contoured to the profile of an associated milling roll.

19. The road milling machine as defined in claim 2 wherein the supporting means has a width corresponding substantially to the width of said first stripping blade.

20. The road milling machine as defined in claim 2 wherein said supporting means is vertically slidingly mounted relative to said first stripping blade.

21. The road milling machine as defined in claim 6 wherein at least a lower stripper edge portion of one of said first and at least one second striping blades is contoured to the profile of an associated milling roll.

22. The road milling machine as defined in claim 6 wherein the supporting means has a width corresponding substantially to the width of said first stripping blade.

23. The road milling machine as defined in claim 6 wherein said supporting means is vertically slidingly mounted relative to said first stripping blade.

24. A method of stripping milled-off material from a surface behind a milling machine comprising the steps of providing first and second milling rollers of different widths corresponding substantially respectively to a predetermined maximum milling width and a less than maximum milling width, providing a first stripping blade and a second stripping blade of widths substantially corresponding respectively to the maximum milling width and less than the maximum milling width, slidably supporting the second stripping blade relative to the first stripping blade, and selectively vertically adjusting at least one of first and second stripping blades to accommodate stripping-off milled-off material from a milled surface depending upon which of the first and second milling rollers is utilized to perform a milling operation.

* * * * *